United States Patent [19]

Pflanz

[11] 3,953,693

[45] Apr. 27, 1976

[54] VACUUM SWITCH WITH INTEGRATED CAPACITOR SHIELD

[75] Inventor: Herbert M. Pflanz, Westwood, Mass.

[73] Assignee: Allis-Chalmers Corporation, Milwaukee, Wis.

[22] Filed: Sept. 9, 1974

[21] Appl. No.: 504,335

[52] U.S. Cl. ..... 200/144 B
[51] Int. Cl.[2] ..... H01H 33/66
[58] Field of Search ..... 200/144 B

[56] References Cited

UNITED STATES PATENTS

| | | | |
|---|---|---|---|
| 2,976,382 | 3/1961 | Lee | 200/144 B |
| 3,040,220 | 6/1962 | Neibaur | 200/144 B |
| 3,109,968 | 11/1963 | Jennings | 200/144 B |
| 3,541,284 | 11/1970 | Wachta | 200/144 B |
| 3,702,911 | 11/1972 | Schonhuber | 200/144 B |
| 3,705,144 | 12/1972 | Genequand | 200/144 B |
| 3,786,214 | 1/1975 | Sofianek | 200/144 B |
| 3,858,076 | 12/1974 | Mitchell | 200/144 B |

*Primary Examiner*—Robert S. Macon
*Attorney, Agent, or Firm*—Robert C. Jones

[57] ABSTRACT

A vacuum switch with integrated capacitor shield comprising an evacuated insulating envelope provided with metallic end cap closures through which relative movable contact rods extend; the evacuated envelope encloses a plurality of shields which also serve as capacitor vanes permanently fixed to another shield and the stationary contact.

3 Claims, 4 Drawing Figures

VACUUM SWITCH WITH INTEGRATED CAPACITOR SHIELD

BACKGROUND OF THE INVENTION

Prior art discloses operating devices such as variable capacitors. However, all such devices relate to the field of radio and are directed to structure which provides adjustment of capacitor plates but do not interrupt current. These types of devices are not as adaptable to being serviced as are vacuum switches, and they are also more costly to manufacture. Combined devices are exemplified as disclosed in U.S. Pat. No. 3,541,284, and as there shown, the capacitors are embedded in the wall of the envelope. Thus, it is apparent that these devices cannot serve as shield members.

Normally vacuum switches are used in series and when so used a means must be provided to assure that the total voltage is shared equally by all of the switches in the series as far as may be practical. Typically a 69 kV capacitor switch will utilize four vacuum switches in series. These are paralleled by individual capacitors of approximately 200 pF, which are sufficiently large to assure proper voltage distribution for the 69 kV switch. Since these capacitors are costly and also require annual checks a less costly and more reliable means is desirable.

In accordance with the present invention, there is provided a vacuum switch which incorporates integral capacitors which are also effective as shields. The capacitors occupy the same space as the interrupter contacts and thus provide a compact, high capacitance vacuum switch.

OBJECTS OF THE INVENTION

It is an object of the present invention to provide an improved electrical circuit interrupter having impedance means in the form of a plurality of capacitors.

Another object of this invention is to provide an improved vacuum switch having integrated capacitor shields wherein the capacitors serve as a labyrinth to shield against diffusion of arc products.

Still another object of the present invention is to provide an improved vacuum switch having integrated capacitor shields in which capacitance may be varied in accordance with a particular application without altering the envelope itself.

Yet another object of the present invention is to provide an improved vacuum switch having integrated capacitors which are compact, extremely durable and simple in construction.

Another object of the present invention is to provide an improved vacuum switch having integrated capacitor members which is capable of being mass produced.

Other objects and advantages of the present invention will hereinafter appear.

DRAWINGS

DESCRIPTION

Figure 3:
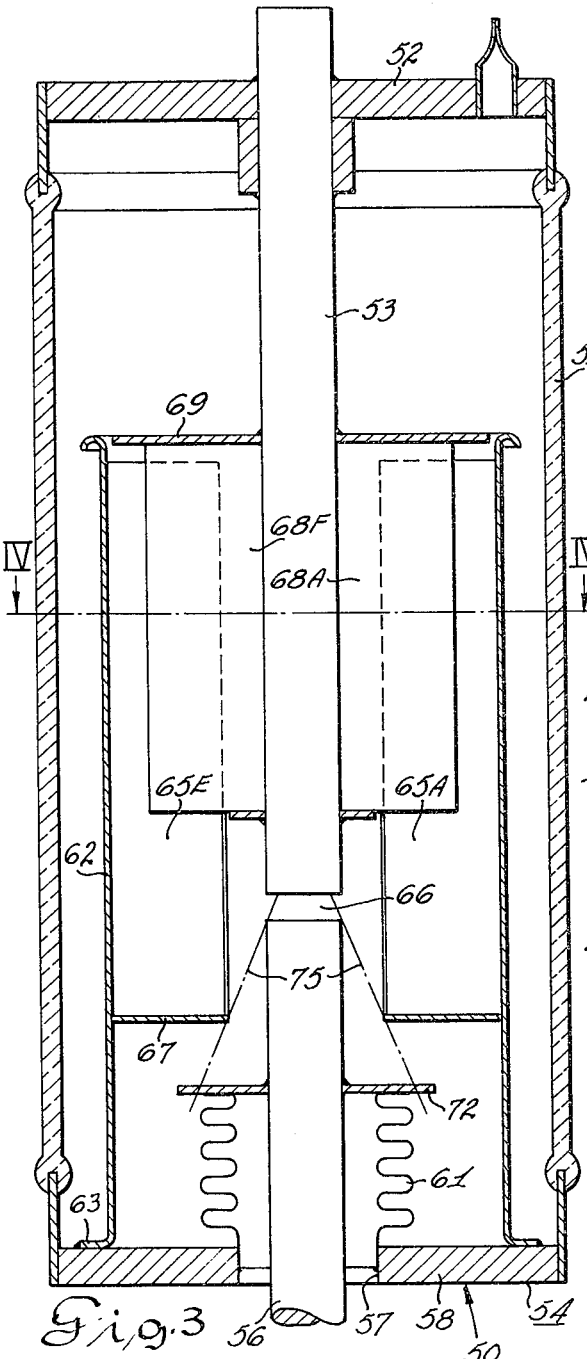
FIG. 3 is a view in vertical section through a modification of the invention; and, FIG. 4 is a view in horizontal section taken in a plane represented by the line IV—IV in FIG. 3.

In the drawing the numeral 10 designates a high capacitance switching device comprising an envelope 11 of insulating material, such as glass, which is hermetically sealed at one end by a closure means such as a metal end cap 12 to which a stationary butt type electrically conductive contact rod 14 is mechanically and electrically connected. The envelope 11 is hermetically sealed at the other end by closure means such as metal end cap 16 similar to the cap 12. An axial movable butt type electrical conductive contact rod 18 is mechanically supported for movement through a suitable axial opening 19 provided in the cap plate 17. The metallic end cap plate 17 of the end cap 16, as previously mentioned, is provided with an axial opening 19 through which the movable contact rod 18 extends for movement into and out of engagement with the axial end of the stationary contact 14. To maintain the seal between the movable contact rod 18 and the end cap plate 17, a bellows 21 is provided. As shown, the bellows 21 is mounted about the movable contact rod 18 and has its lower ends secured in sealed relationship to the wall of the opening 19. The upper end of the bellows 21 is brazed in vacuum tight relationship to a plate 22 that, in turn, is brazed to the rod 18. Thus, the bellows 21 permits limited axial movement of the contact rod 18 while maintaining the integrity of the vacuum within the envelope 11.

Within the envelope 11 there is provided a metallic shield member 23 which is in the form of a tube that is easily formed at relatively low cost. The shield member 23 at its lower end is provided with a radially extending flange 24 which is adapted to be supported on the end cap plate 17. To secure the shield member 23 in operative position, the flange 24 is brazed to the end cap plate 17.

Within the outer shield member 23 there is provided a circular plate or disc member 26. An axial opening 27 in the disc 26 permits the contact rod 18 to extend therethrough for free movement into and out of electrical engagement with the stationary contact rod 14.

Extending upwardly is a shield member 30 comprising a plurality of tubular concentrically disposed shields 31, 32 and 33. As shown, the tubular shields 31, 32 and 33 are brazed to the horizontally disposed disc 26. For maintaining the shield member 30 in operative position the disc 26 is brazed to the inner surface of the outer tubular shield 23. The spacing between the individual tubular shield 31, 32 and 33 and the outer shield 23 is such as to provide spaces 41, 42 and 43.

Within the spaces 41, 42 and 43 are disposed a plurality of tubular depending shields 46, 47 and 48 of an interengaged shield member 45. The individual depending shields 46, 47 and 48 are maintained in operative positions and spaced equally distant from adjacent upstanding shields by being brazed to a circular disc 49 which, in turn, is brazed to the stationary contact 14.

Thus, the upstanding shields 31, 32 and 33 alternately spaced between the depending shields 46, 47 and 48 form a labyrinth passage which effectively intersects arc particles which are generated on separation of the contacts. Any arc particle which tends to drift downwardly through the opening 27 of the disc 26 and which may possible adhere to the bellows 21 to thereby effect the efficiency of the bellows 21 will impinge upon a bellows plate 22. To prevent contamination of the bellows 21, the bellows plate 22 is constructed with a diameter such that its peripheral edge extends beyond a line-of-sight path represented by the broken lines 51. As illustrated, the line-of-sight path 51 is tangent to the wall of the opening 27 and also tangent to the edge of the contact rod 18 and intersects the bellows plate 22 at a point that is inwardly from the periphery thereof.

Since the bellows plate 22 extends beyond the line-of-sight paths, arc particles will accumulate on the plate itself or be deflected thereby to fall harmlessly to the end cap plate 17. However, this presents no problem since the outer shield 23 extends to the cap plate 17 and affords full protection to the envelope 11. Thus, the bellows plate 22 directly protects the bellow 21 itself from arc particles accumulating thereon.

Since the interengaged shield members 30 and 45 are isolated from each other by the vacuum of the envelope they not only provide a particularly efficient screen but also serve as capacitors. With the arrangement shown, each capacitance value is determined approximately by the tube area times the dielectric constant and is inversely proportional to the spacing. The particular vacuum switch arrangement described will provide 100 pF of capacitance and when used in multiple arrangement will serve as a voltage grading means. The switch described provides a low cost relatively maintenance free self-healing capacitor-vacuum switch combination. The capacitor-vacuum switch combination requires little or no service checks to assure proper dielectric quality.

Figure 1:
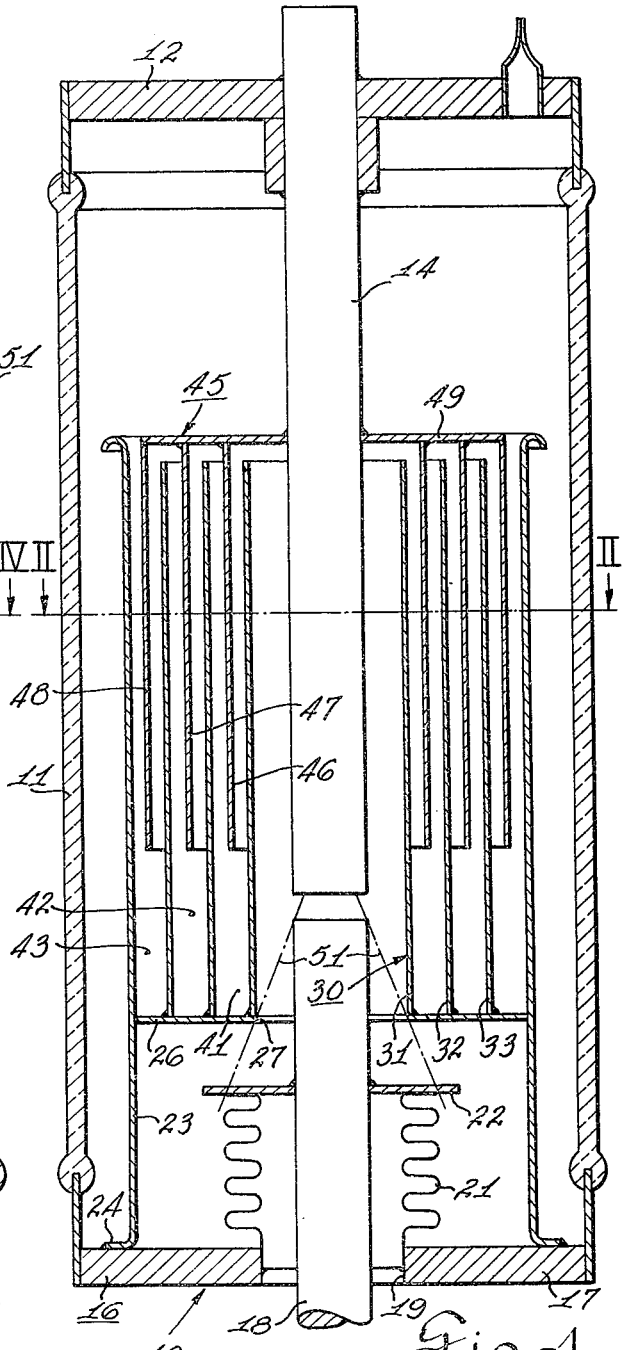
FIG. 1 is a view in vertical section through the vacuum switch showing the device when the contact rods are in open position.
Figure 4:
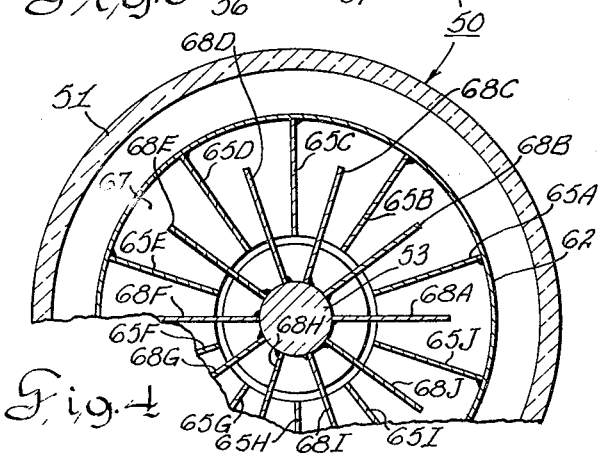
Figure 2:
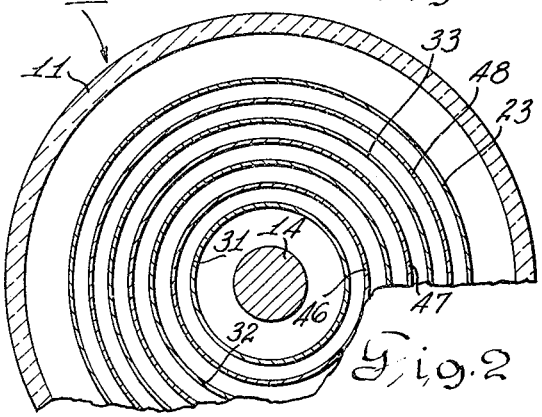
FIG. 2 is a view in horizontal section taken in a plane represented by the lines II—II in FIG. 1.

In FIGS. 3 and 4 a modification of the switch of FIG. 1 is shown. As there indicated, number 50 designates a capacitor-vacuum switch with integrated capacitor shielding structure and comprising an insulated envelope 51, similar to the envelope 11 of FIG. 1. One end of the envelope 51 is hermetically sealed by metallic end cap 52 which is adapted to support a stationary butt type electrically conductive contact rod 53. The opposite end of the envelope 51 is hermetically sealed by a metallic end cap 54. The end caps 52 and 54 are similar to the end caps 12 and 16 associated with the envelope 10. An axial movable butt type electrical contact rod 56 is mechanically supported for movement through an axial opening 57 formed in the metallic plate 58 of the end cap 54. A bellows 61 is provided to maintain the integrity of the vacuum in the envelope 51 while still allowing limited axial movement to the contact rod 56.

Within the envelope 51 there is provided a tubular shield member 62 similar to the tubular shield member 23. At its lower end the shield member 62 is provided with a radial outwardly extending flange 63 which abuts the metallic end plate 58 of the end cap 54 and is brazed in fixed position thereon.

Equally spaced around the inner surface of the shield member 62 is a plurality of vertically extending baffle plates, which in this instance are 10 in number, 65A through 65J. The baffle plates extend downwardly to a horizontal plane which is located below the arc gap 66 that occurs between the contact rods 53 and 56 when the movable contact rod 56 is in a full open position. The lower ends of the baffle plates 65A through 65J abut a circular plate 67 and are brazed thereto so that the baffle plates are rigidly held in a fixed position. The circular plate 67 abuts the inner surface of the outer tubular shield 62 and is brazed thereto.

Interengaged between the baffle plates 65A through 65J are a plurality of radially extending plates 68A through 68J which are secured as by being brazed to the peripheral surface of the stationary contact rod 53. The radially extending contact rod plates 68A through 68J extend towards the tubular shield 62 but do not contact it or the associated adjacent baffle plates 65A through 65J. To rigidly hold the plates 68A through 68J in position the upper ends of the plates are brazed to a horizontal circular plate 69 that is, in turn, brazed in fixed position to the stationary contact rod 53. As can be seen, the horizontal circular plate 69 does not engage the shield 62 so that no electrical circuit is established between them.

Thus, the interengaged relationship between the baffle plates 65 and radial plates 68 provide a multiplicity of surfaces on which arc particles may impinge and adhere. Particles that do not adhere to the vertical plates will drop to the horizontal circular plate 67 and accumulate thereon. On the other hand the upper plate 69 effectively prevents the stray particles from escaping the shield structure and turns these particles back into the baffle structure.

For protecting the bellows 61 a bellows plate 72, which is brazed to the movable contact rod 56 and to which the upper ends of the bellows 61 is brazed, is provided. The bellows plate 72 is of sufficiently large diameter so that its peripheral edge extends beyond the opening in the circular plate 67. The arrangement is similar to that described in conjunction with the bellows plate 22 associated with the switch 10. Thus, a line-of-sight path as represented by the broken lines 75 and which is tangent to the edge of the contact rod 56 when the contact rod 56 is in its full open position, and which is also tangent to the edge of the opening in the plate 67 will intersect the surface of the bellows plate 72 well back of the edge thereof. Thus, any arc particles which filter through the opening in the plate 67 will accumulate on the bellows plate 72. However, should arc particles deflect from the bellows plate 72 they cannot reach the envelope 51 because of the tubular shield 62.

The interengagement of baffle plates 65 and radial plates 68 also serve as capacitors. The value of each capacitor is approximately determined by the vane area times the dielectric constant and is inversely proportional to the spacing. The particular embodiment shown in FIGS. 3 and 4 will provide typically 100 pF of capacitance and like the structure FIG. 1 when used in multiple arrangement will serve as a voltage grading means.

As is apparent, switches such as switches 10 and 50 have the capacitance structure integral with the switch structure itself and require no external attachments. It is also apparent that the dielectric integrity of the vacuum switch extends also to the capacitance means. Thus, an efficient low cost vacuum switch with integral capacitors is provided and thereby reduces the number of components required.

The embodiments of the invention in which an exclusive property or privilege is claimed are defined as follows:

1. In a vacuum switch having an integral capacitor;

an insulating cylindrical envelope having its opposite ends hermetically sealed by metallic end caps;

a stationary contact rod extending through the first of said metallic end caps into said envelope, said stationary contact rod being supported by said end cap in vacuum sealed relationship;

a movable contact rod extending through the second of said metallic end caps, said movable contact rod being operably supported by the second of said end caps in vacuum sealed relationship for axial movement into and out of electrical engagement with said stationary contact rod;

a bellows secured in vacuum tight relationship around said movable contact rod and to said second metallic end cap to provide for limited axial movement of said movable contact rod and ensuring the integrity of the envelope;

a first group of plates carried by said stationary contact rod, each plate of said first group of plates being operable to serve as an element of a capacitor;

a second group of plates fixed with respect to said first group of plates and carried by said second metallic end cap but not in electrical contact with said movable contact rod and extending between said plates of said first group of plates, said plates of said second group of plates serving as another element of a capacitor, said plates of said first and second group of plates being electrically interrelated to provide impedance in parallel with said contact rods for voltage distribution in the switch;

a tubular shield surrounding said contact rods in concentric relationship, said tubular shield being secured to said second end closure;

a circular lower deflector plate having an axial opening disposed in said tubular shield and around said movable contact in concentric relationship, said circular lower deflector plate being disposed in abutting and secured engagement with the lower ends of the plates of said second group of plates;

a bellows plate mounted about and secured in vacuum tight relationship to said movable contact rod said bellows plate being disposed adjacent to the inner end of said bellows and being of a diameter which is greater than the diameter of said bellows to thereby serve as an umbrella to deflect arc particles from striking said bellows, said bellows plate diameter being sufficient so that a line-of-sight path, which is tangent to the contact edge of said movable contact rod when in open position and also tangent to the lower inner edge of said plates of said second group of plates, intersects the surface of said bellows plate inwardly of the edge thereof;

said circular lower deflector plates serving to accumulate arc particles to prevent a buildup of arc particles on the second end cap and said tubular shield prevents arc particles which escape the circular lower deflection plate from reaching said insulating envelope and said circular lower deflector plate also reinforces the plates of said second group of plates to maintain them in operative position.

2. In a vacuum switch having an integral capacitor;

a tubular sealed envelope the interior of which is highly evacuated;

closure end caps joined to said envelope to seal the ends thereof, said closure end caps being electrically isolated from each other;

a stationary contact rod supported in one of said closure end caps in sealed relationship therewith, said stationary contact rod extending into said envelope;

a movable contact rod supported in the other of said closure end caps;

a bellows operatively arranged to provide a seal between said movable contact rod and the associated other closure end cap to permit limited axial movement of said movable contact rod into and out of abutting electrical engagement with said stationary contact rod;

a metallic tubular shield carried by said other closure end cap associated with said movable contact rod, said tubular shield encompassing said contact rods and having its free end extending towards said closure end cap associated with said stationary contact rod to a point short thereof;

a first group of equally spaced apart plates carried by said stationary contact rod and extending radially outwardly therefrom towards said tubular shield but not in contact with said tubular shield;

a first circular plate secured to said stationary contact rod and disposed in the plane in which the free end of said tubular shield is located, said circular plate being of a diameter which is slightly less than the diameter of said tubular shield, said first circular plate being secured to the adjacent ends of each plate of said first group of plates;

a second group of equally spaced apart plates carried by said tubular shield and extending radially inwardly therefrom towards the axes of said contact rods, said second group of plates being arranged to extend between the plates of said first group in alternate relationship, said plates of said second group of plates extending from a point short of the free end of said tubular shield towards the closure end cap associated with said movable contact rod to a point short thereof;

a second circular plate having an axial opening encompassing said movable contact rod but not in engagement therewith, said second circular plate being secured to the ends of said plurality of plates carried by said tubular shield and to the inner surface of said tubular shield; and, a third circular plate secured to said movable contact rod between said bellows and the said second circular plate, said third circular plate having a diameter which is sufficient so that the edge thereof extends beyond the edge of said bellows and also so that a line-of-sight path which is tangent to the edge of that portion of said movable contact rod which engages the end of said stationary contact rod and which is also tangent to the edge of the wall of the opening in said second circular plate intersects the surface of said third circular plate;

whereby said interrelated plates operate to intercept arc particles and said first circular plate operates to deflect arc particles back into said interrelated plates and said second circular plates intercepts and accumulates arc particles and said third circular plate protects said bellows from arc particles which drift through the opening in said second circular plate and deflect such drifting arc particles outwardly towards said tubular shield and said interrelated plates operate as capacitance elements of a capacitor integral in said vacuum switch.

3. In a vacuum switch having an integral capacitor;

an insulating cylindrical envelope having its opposite ends hermetically sealed by metallic end caps;

a stationary contact rod extending through the first of said metallic end caps into said envelope, said stationary contact rod being supported by said end cap in vacuum sealed relationship;

a movable contact rod extending through the second of said metallic end caps, said movable contact rod being operably supported by the second of said end caps in vacuum sealed relationship for axial movement into and out of electrical engagement with said stationary contact rod;

a first group of plates carried by said stationary contact rod and constructed and arranged in equispaced relationship around said stationary contact rod and extend radially outward therefrom, each plate of said first group of plates being operable to serve as an element of a capacitor;

a second group of plates carried by said second metallic end cap but not in electrical contact with said movable contact rod and extending between said plates of said first group of plates in equispaced relationship about the axis of said contact rods and interengaged in alternating relationship with the plates of said first group of plates but not in physical contact with them, said plates of said second group of plates serving as another element of a capacitor, said plates of said first and second group of plates being electrically interrelated to provide impedance in parallel with said contact rods for voltage distribution in the switch; and, a circular reinforcing deflector plate secured to said stationary contact rod and overlying said first group of plates and extending radially beyond the free edges of said plates, said plates being rigidly secured to said reinforcing deflector plate, said deflector plate also serving as a deflector shield to deflect upwardly moving arc particles downwardly into the interengaged plates.

* * * * *